US007370779B1

(12) United States Patent
Dunkirk

(10) Patent No.: US 7,370,779 B1
(45) Date of Patent: May 13, 2008

(54) COAT HANGER EXTENSION SLEEVE

(76) Inventor: Robert D Dunkirk, 181 Woodhull Ave., Riverhead, NY (US) 11901

( * ) Notice: Subject to any disclaimer, the term of this patent is extended or adjusted under 35 U.S.C. 154(b) by 0 days.

(21) Appl. No.: 11/257,463

(22) Filed: Oct. 24, 2005

(51) Int. Cl.
*A41D 27/22* (2006.01)

(52) U.S. Cl. ..... 223/98

(58) Field of Classification Search ..... 223/85, 223/87, 88, 92, 98; D6/315, 316, 318, 319, D6/328; 150/154
See application file for complete search history.

(56) References Cited

U.S. PATENT DOCUMENTS

| | | | | | |
|---|---|---|---|---|---|
| 779,062 | A | | 1/1905 | Beatty | |
| 1,321,997 | A | * | 11/1919 | Duberstein | 223/92 |
| 1,740,566 | A | | 12/1929 | Batts | |
| 2,062,566 | A | * | 12/1936 | Fletcher et al. | 223/88 |
| 2,137,824 | A | * | 11/1938 | Myrtle | 223/98 |
| 2,353,839 | A | | 7/1944 | McFall | |
| 2,420,101 | A | * | 5/1947 | Samann | 223/88 |
| D162,048 | S | * | 2/1951 | Lynch | D6/318 |
| 2,597,509 | A | * | 5/1952 | Mallory | 223/88 |
| 2,622,775 | A | * | 12/1952 | Sasaki | 223/98 |
| 2,675,948 | A | * | 4/1954 | Mallory | 223/98 |
| 3,059,824 | A | * | 10/1962 | Henry | 223/88 |
| 3,167,224 | A | | 1/1965 | Landers | |
| 3,301,447 | A | * | 1/1967 | Felton | 223/98 |
| 3,807,609 | A | * | 4/1974 | Tymoszek | 223/88 |
| 4,658,997 | A | * | 4/1987 | Nash | 223/98 |
| 5,390,835 | A | | 2/1995 | Murphy et al. | |
| D360,306 | S | * | 7/1995 | Hodzen | D6/328 |
| D369,908 | S | * | 5/1996 | Pfutzenreuter | D6/328 |
| 5,718,362 | A | | 2/1998 | Silverman | |
| D407,909 | S | * | 4/1999 | Pfutzenreuter | D6/328 |
| 6,012,620 | A | | 1/2000 | Murray | |
| D427,782 | S | * | 7/2000 | St. L-Morency | D6/328 |
| 6,499,636 | B1 | | 12/2002 | McCool | |
| 6,581,810 | B1 | * | 6/2003 | Ho | 223/87 |
| 6,644,521 | B1 | * | 11/2003 | Tiss et al. | 223/98 |

FOREIGN PATENT DOCUMENTS

| | | |
|---|---|---|
| CA | 2.126.139 | 12/1995 |
| GB | 2.387.952 | 10/2003 |

* cited by examiner

*Primary Examiner*—Gary L. Welch
*Assistant Examiner*—Nathan E Durham
(74) *Attorney, Agent, or Firm*—Michael I Kroll

(57) ABSTRACT

Apparatus 10 discloses a stackable extension sleeve for a coat hanger 22. The stackable extension sleeve is comprised of a unitary body having a curvilinear top surface 26 sloping down from a central aperture 14 with a back wall 28 extending to the base 30 of the opposing ends and a front triangular-shaped skirt 32 having a slot 16 in communication with the aperture. The bottom edge 30 of the extension sleeve forms a horizontal perimeter whereby the extension sleeve can stand unaided and stacked one upon another.

1 Claim, 8 Drawing Sheets

COAT HANGER EXTENSION SLEEVE

BACKGROUND OF THE INVENTION

1. Field of the Invention

The present invention relates generally to apparel apparatus and, more specifically, to a stackable extension sleeve for a coat hanger. The stackable extension sleeve is comprised of a unitary body having a curvilinear top surface sloping down from a central aperture with a back wall extending to the base of the opposing ends and a front triangular-shaped skirt having a slot in communication with said aperture. The bottom edge of the extension sleeve forms a horizontal perimeter whereby the extension sleeve can stand unaided and stacked one upon another.

The present invention also provides for additional elements in the form of means for positioning the extension sleeve on a coat hanger and means for aiding in the retention of a garment once placed on said extension sleeve.

Serving as means for positioning the extension sleeve, the present invention provides a plurality of wedge-like projections depending from the underside of the top surface having a wedge bottom surface with the opposing ends angularly displaced. In the preferred embodiment, the angularity extends to its deepest point toward the back wall causing the sleeve back wall to substantially engage the provided hanger. Additionally, the plurality of wedges can be formed with the deepest end toward the front wall or by reversing every other wedge-angularity would essentially cause the coat hanger to reside between the sleeve's front and back wall.

In lieu of or in addition to, the present invention provides for aiding in the retention of a garment once placed on said extension sleeve by incorporating a frictional material covering the top surface in whole or in part thereby preventing casual displacement of the garment when place over the extension sleeve and user provided hanger.

2. Description of the Prior Art

There are other sleeve-like devices designed for coat hangers. Typical of these is U.S. Pat. No. 779,062 issued to Beatty on Jan. 5, 1905.

Another patent was issued to Batts on Dec. 24, 1929 as U.S. Pat. No. 1,740,566. Yet another U.S. Pat. No. 2,353,839 was issued to McFall on Jul. 18, 1944 and still yet another was issued on May 6, 1947 to Samann as U.S. Pat. No. 2,420,101.

Another patent was issued to Landers on Jan. 26, 1965 as U.S. Pat. No. 3,167,224. Yet another U.S. Pat. No. 3,301,447 was issued to Felton on Jan. 31, 1967. Another was issued to Tymoszek on Apr. 30, 1974 as U.S. Pat. No. 3,807,609 and still yet another was issued on Apr. 21, 1987 to Nash as U.S. Pat. No. 4,658,997.

Another patent was issued to Murphy et al. on Feb. 21, 1995 as U.S. Pat. No. 5,390,835. Yet another U.S. Pat. No. 5,718,362 was issued to Silverman on Feb. 17, 1998. Another was issued to Murray on Jan. 11, 2000 as U.S. Pat. No. 6,012,620 and still yet another was issued on Dec. 31, 2002 to McCool as U.S. Pat. No. 6,499,636.

Another patent was issued to Bastani, et al. on Dec. 18, 1995 as CA2,126,139 and still yet another was issued on Oct. 29, 2003 to Ball as U.K. Patent No. GB2387952.

U.S. Pat. No. 779,062

Inventor: Robert P. Beatty

Issued: Jan. 3, 1905

In a coat-hanger, the combination of a body portion, comprising a single sheet of metal bent to form, provided with two outwardly-extending members; and shoulder pieces each formed of a single sheet of metal and being secured to said outwardly-extending members.

U.S. Pat. No. 1,740,566

Inventor: Walter H. Batts

Issued: Dec. 24, 1929

A garment hanger comprising a wire frame having diverging shoulder members and a horizontal bottom member and a cardboard covering folded over said garment hanger and having an elongated slot to expose the greater portion of the length of said horizontal lower member of the wire frame.

U.S. Pat. No. 2,353,839

Inventor: William W. McFall

Issued: Jul. 18, 1944

An article of manufacture comprising a shoulder tree for imposition upon a garment hanger, consisting of a medial portion and a wing extension on either side thereof, the medial portion including a pair of parallel vertical walls spaced apart, the wing extensions being curved in transverse section with their sides inclined obliquely with respect to the vertical walls, and approximately triangular portions uniting the vertical walls and the sides of the wing extensions.

U.S. Pat. No. 2,420,101

Inventor: Eric L. Samann

Issued: May 6, 1947

A substantially rigid padding member adapted for use in combination with a wire coat hanger having a hook portion and a pair of inclined shoulder supporting strands, said padding member having a central channel-shaped collar conforming portion provided with a slot through which the hook portion of said wire hanger is adapted to be passed, inclined shoulder supporting portions of channel shape extending from said collar portion tapering outwardly and downwardly therefrom and terminating in widened channel-shaped shoulder conforming and supporting sections, and means associated with said inclined portions of said padding member for securely engaging and gripping the inclined shoulder supporting strands of said wire coat hanger, said means including a pair of spaced substantially rigid blocks located between the collar and shoulder supporting portions of said padding member.

U.S. Pat. No. 3,167,224

Inventor: William D. Landers

Issued: Jan. 26, 1965

A protecting cover for garments suspended by a garment hanger having a suspension hook and shank depending therefrom, said protecting cover comprising an elongated cover member formed from thin transparent plastic material and having an inverted substantially U-shaped vertical cross-section with an open bottom, a pair of flat and transversely spaced side walls and a top wall coextensive with and connecting together upper edges of said side walls in transversely spaced relation along their entire length, said cover member conforming closely to the configuration of a garment suspended by the hanger, said top wall of the cover member including a horizontally flat center portion provided with an oval shaped opening for passage of hanger hook therethrough, and an upstanding oval flange provided on said top wall center portion contiguously with the edge of said opening, said flange projecting above the upper surface of said top wall center portion to surround the garment hanger hook shank in closely spaced relation above the top wall center portion and to afford a finger-piece for handling the cover, the opposite side portions of said flange being parallel with and spaced inwardly from the planes of said side walls of the cover member, whereby regions of the top wall center portion between said side walls and said opposite side portions of said flange may act to reinforce the same.

U.S. Pat. No. 3,301,447

Inventor: Ethilia A. Felton

Issued: Jan. 31, 1967

The combination of a conventional wire garment hanger having a horizontal center portion provided with a suspension hook and a pair of sloping shoulder portions extending from the ends of said center portion, and a garment supporting attachment formed integrally from one piece of material, said attachment comprising a horizontally elongated oval-shaped collar member overlying said center portion of said hanger, said collar member having an open top, a continuous upstanding side wall and a closed bottom formed with a passage having said suspension hook of the hanger projecting upwardly therethrough, a pair of elongated sloping shoulder members extending from the ends of said collar member and overlying said shoulder portions of the hanger, said shoulder members being substantially wider than the thickness of the hanger and having a transversely curved across-section with relatively wide outer regions and relatively narrow inner regions, said inner regions of the shoulder members being connected to and of substantially the same width as said collar member, reinforcing ribs extending the length of and centrally on the underside of said shoulder members in substantial alignment with the shoulder portions of the hanger, and block-like projections depending from said ribs under said wide outer regions of the shoulder members, said projections being provided at the underside thereof with downwardly extending open slots frictionally receiving therein the shoulder portions of the hanger whereby to coact with the projection of said suspension hook through said collar member passage in retaining the attachment in position on the hanger.

U.S. Pat. No. 3,807,609

Inventor: Raymond Tymoszek

Issued: Apr. 30, 1974

A removable sheath of an expanded plastic material such as Styrofoam, polyurethane or polystyrene having a horizontal bar and shoulder support bars to be used with a wire garment hanger. A slot extends through the removable sheath to enable the insertion therein of a wire garment hanger such that the only part of the wire hanger that extends beyond the boundaries of the removable sheath is the wire hanger hook. The horizontal bar and shoulder support bars are of a substantial thickness to prevent creasing of garments hanging therefrom.

U.S. Pat. No. 4,658,997

Inventor: Stacy B. Nash

Issued: Apr. 21, 1987

An improved display hanger cover supportable by a clothes hanger to convert the hanger to function as a display hanger for supporting a garment, comprising an elongated body portion having a hollow interior, substantially curvilinearly shaped front and rear walls, and substantially curvilinearly shaped first and second shoulder portions disposable over the side arms of the clothes hanger. A neck portion is supported at the confluence of the first and second shoulder portions with the front and rear walls, and the neck portion has a substantially planar upper surface through which is provided a hook passage slot communicating with the hollow interior. First and second slot portions of the hook passage slot are shaped to respectively pass and selectively retain the hanger neck portion of the clothes hanger, thus permitting angular adjustment of the clothes hanger within the hollow body portion when the display cover hanger is disposed over the clothes hanger. For stabilizing the display hanger cover on a wire hanger, the neck portion of the display hanger cover is provided with a third slot portion communicating with the second slot portion and disposed substantially parallel to the first slot portion, thus permitting at least a portion of the neck of the wire hanger to extend through the third slot portion for securing and stabilizing the display hanger cover on the wire hanger.

U.S. Pat. No. 5,390,835

Inventor: William L. Murphy, et al.

Issued: Feb. 21, 1995

A cover for a garment hanger and comprising opposed first and second arms, which are foldable about an axis. In the folded position, the first and second arms are in a coterminously overlying relationship to minimize the area occupied by the folded cover. In the unfolded position, the top of the cover forms a ridge and the sides of the shoulder guard extend outwardly away from the hanger for supporting the garment draped over the cover in a natural position to reduce hanger marks and creases.

U.S. Pat. No. 5,718,362

Inventor: Harvey I. Silverman

Issued: Feb. 17, 1998

In one embodiment, the telescopic sleeve overlay for a garment hanger is used in conjunction with a common type hanger. Common hangers usually are made of wire or stiff rods which form a shallow, inverted U-shape depending from an inverted U-shaped hanger head. The hanger head is adapted to be hung on a clothing rod. The sleeve overlay includes an inverted U-shaped base and two longitudinally movable inverted U-shaped sleeves. The sleeves move inboard and outboard on the base and move with respect to a centrally located cut-out on the base. The hanger head from the hanger extends through the cut-out. The base extends longitudinally over substantially the entire length of the hanger wire. In one embodiment, the sleeves are guided on the base by guides formed either at the lower edges of the sleeves or at the lower edges of the base. Inboard and outboard stops prevent the sleeves from being completely withdrawn from the base or being forced towards the apex of the hanger. A hanger head is utilized having an inverted U-shaped hanger hook and a par of legs extending in opposite directions from a base portion of the hanger hook. Each leg has an upstanding clip tab thereat. The base of the garment hanger defines an inverted, U-shaped lateral cross-section and a longitudinally centered cut-out. The hanger head protrudes through the cut-out and each upstanding clip tab removably locks onto an edge portion which defines the base cut-out. A pair of longitudinally moveable, inverted U-shaped sleeves are movably mounted atop opposing end regions of the base.

U.S. Pat. No. 6,012,620

Inventor: Barbara J. Murray

Issued: Jan. 11, 2000

A garment hanger attachment is presented that is formed of a unitary, elongated, flexible body. The body has a partial slit running lengthwise from a point proximal to one end of the body to a point proximal to the other end of the body. In the center of the body, the slit traverses through the entire diameter of the body to allow the hook of the hanger to pass through. The overall shape of the body is formed lengthwise along a single axis, with the slit being molded or cut into the body. The garment hanger attachment is attached to a garment hanger through frictional engagement in the slit or through elastic stretching from one end of the hanger to the other. The attachment is elongated in a straight-line before being attached to the garment hanger, but conforms to the shape of the hanger when attached.

U.S. Pat. No. 6,499,636

Inventor: Lynda McCool

Issued: Dec. 31, 2002

An improved clothing protector comprising a cover for clothes hangers shaped to slip over the hook of the hanger and to be supported by the wings of the hanger and formed two panels of foam material, such as polyurethane, having substantial thickness, such as ½ inch, which have their butt edges joined along their upper edges, leaving a space to receive the hook of the hanger, and formed with a slip-resistant surface. After joining, the panels to tend to flare out, thereby providing a surface of substantial area for supporting an article of clothing.

Canadian Patent Number CA2,126,139

Inventor: Mark Bastani, et al.

Issued: Dec. 18, 1995

A clip-on hanger cover for use on existing wire or plastic hangers to protect the shape of the shoulders of most garments. The mentioned item is made of one piece molded plastic with two integral clips to accept 2 different predetermined diameters of hanger webs.

U.K. Patent Number GB2387952

Inventor: Nigel William Ball

Issued: Oct. 29, 2003

A novelty display device for use with a garment hanger of the type having a hook, shoulders for supporting a garment and an elongate neck intermediate the hook and the shoulders. The novelty display device comprises first and second display panels connected together by a first fold, an aperture in the first fold through which the neck of the hanger may pass, and movement limiting means engage the shoulders of the hanger to limit the extent to which the neck passes through the aperture, so that in use the display panels cover the junction between the neck and the shoulders of the hanger.

While these apparel apparatus may be suitable for the purposes for which they were designed, they would not be as suitable for the purposes of the present invention, as hereinafter described.

SUMMARY OF THE PRESENT INVENTION

The present invention discloses a stackable extension sleeve for a coat hanger. The stackable extension sleeve is comprised of a unitary body having a curvilinear top surface sloping down from a central aperture with a back wall extending to the base of the opposing ends and a front triangular-shaped skirt having a slot in communication with the aperture. The bottom edge of the extension sleeve forms a horizontal perimeter whereby the extension sleeve can stand unaided and stacked one upon another.

A primary object of the present invention is to provide an oversized sleeve for a coat hanger.

Another object of the present invention is to provide a coat hanger sleeve that will support an article without leaving hanger marks on the garment.

Yet another object of the present invention is to provide a coat hanger sleeve that can stand upright on its bottom edge and is therefor stackable.

Still yet another object of the present invention is to provide a coat hanger sleeve having a central aperture with a curvilinear top surface sloping therefrom.

Another object of the present invention is to provide a coat hanger sleeve having a back wall terminating in linear alignment with the opposing ends.

Yet another object of the present invention is to provide a coat hanger sleeve having a front triangular-shaped skirt depending from the top surface and whose edge is substantially parallel with the slope of the top surface.

Still yet another object of the present invention is to provide a slot in the front skirt extending from the skirt base to the central aperture whereby a hook and shank can be inserted therethrough.

Another object of the present invention is to provide a coat hanger sleeve incorporating means for positioning the extension sleeve on a coat hanger.

Yet another object of the present invention is to provide a coat hanger sleeve wherein said means for positioning said sleeve on said coat hanger comprises a plurality of wedge-like projections depending from the underside of the top surface having opposing wedge ends angularly displaced from one another.

Still yet another object of the present invention is to provide a coat hanger sleeve incorporating means for aiding in the retention of a garment once placed thereon.

Another object of the present invention is to provide a coat hanger sleeve wherein said means for aiding in the retention of a garment comprises a frictional material covering the top surface in whole or in part thereby preventing casual displacement of the garment when place over the extension sleeve and user provided hanger.

Additional objects of the present invention will appear as the description proceeds.

The present invention overcomes the shortcomings of the prior art by providing a stackable extension sleeve for a coat hanger. The stackable extension sleeve is comprised of a unitary body having a curvilinear top surface sloping down from a central aperture with a back wall extending to the base of the opposing ends and a front triangular-shaped skirt having a slot in communication with said aperture. The bottom edge of the extension sleeve forms a horizontal perimeter whereby the extension sleeve can stand unaided and stacked one upon another.

In addition the present invention provides additional elements for the coat hanger sleeve comprising a plurality of wedge-like projections depending from the underside of the top surface having a wedge bottom surface with the opposing ends angularly displaced and/or frictional material covering the top surface in whole or in part to prevent casual displacement of the garment when placed over said sleeve and user provided hanger. In the preferred embodiment, the wedge-angularity extends to its deepest point toward the back wall causing the sleeve back wall to substantially engage the provided hanger.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
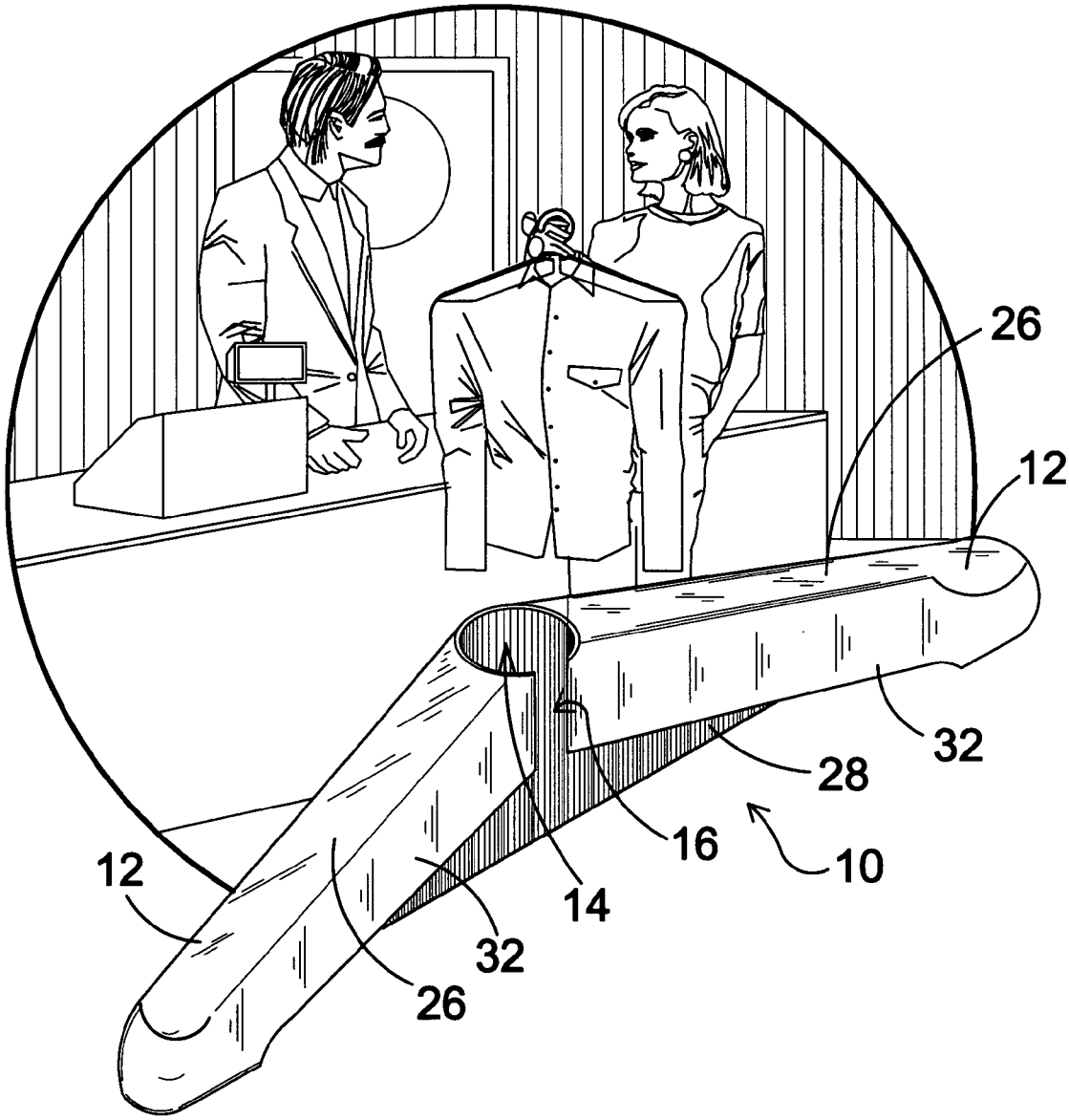
FIG. 1 is an illustrative view of the present invention in use.

With regard to reference numerals used, the following numbering is used throughout the drawings.

10 present invention
12 arms
14 aperture
16 slot
18 support
20 hook
22 hanger
24 garment
26 curvilinear arms
28 back wall
30 bottom
32 skirt wall
34 space
36 feet
38 frictional material
40 nubs
42 wedge-like projections

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses an extension sleeve for any coat hanger comprised of divergent arms 12 converging at a center point having an aperture 14 with a slot 16 for inserting the hook shank of a coat hanger therein. The divergent arms 12 have a curvilinear top surface at 26 sloping downwardly away from aperture 14 having a back wall 28. Skirt 32 is also shown.

Figure 2:
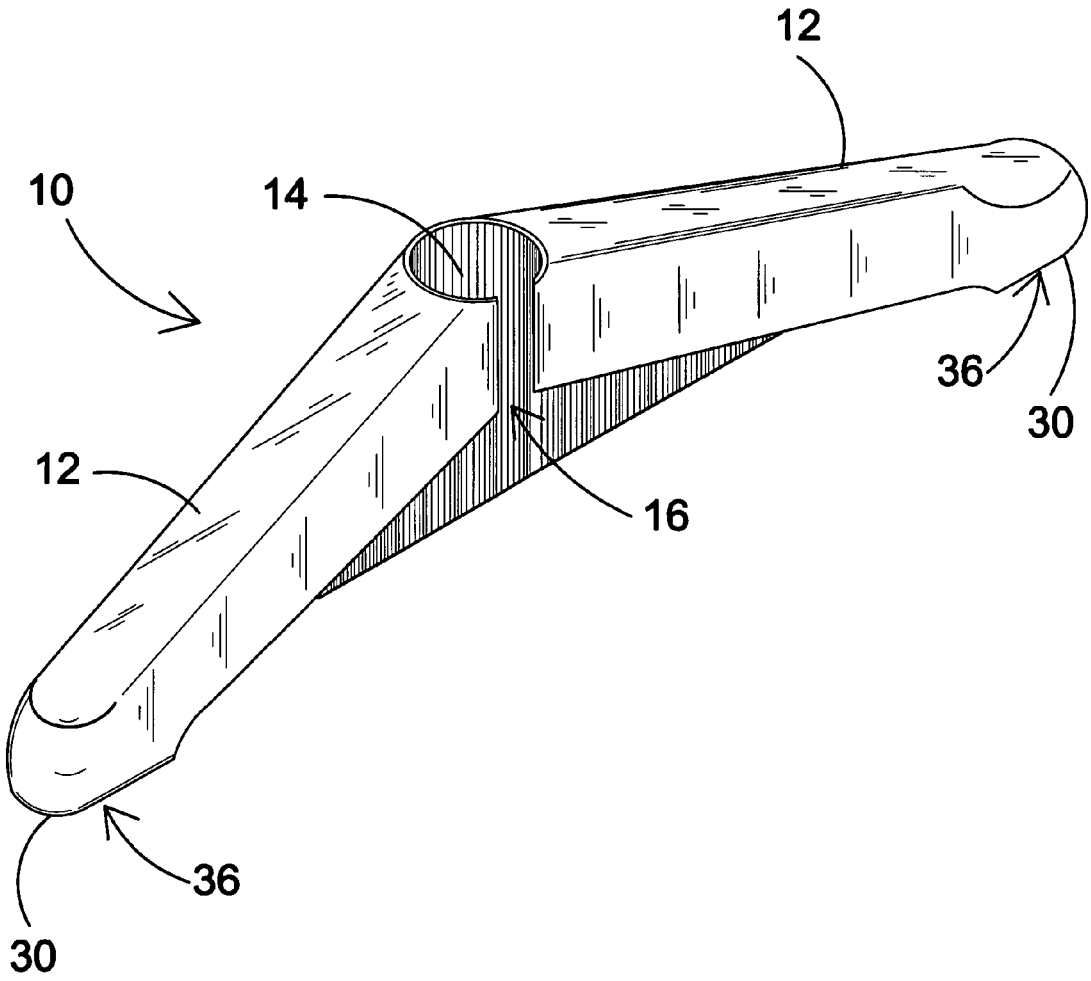
FIG. 2 is a perspective view of the present invention.

Turning to FIG. 2, shown therein is a perspective view of the present invention 10. The present invention 10 discloses an extension sleeve for any coat hanger comprised of divergent arms 12 converging at a center point aperture 14 having a slot 16 for inserting the hook shank therein. The device 10 is designed to give a more substantial shoulder hanging support to any garment being hung, such as a shirt, blouse, sweater or jacket. Note that the bottom 30 is effectively wide and also forming feet 36 on each end to allow the present invention 10 to stand unaided and be stacked one upon another.

Figure 3:
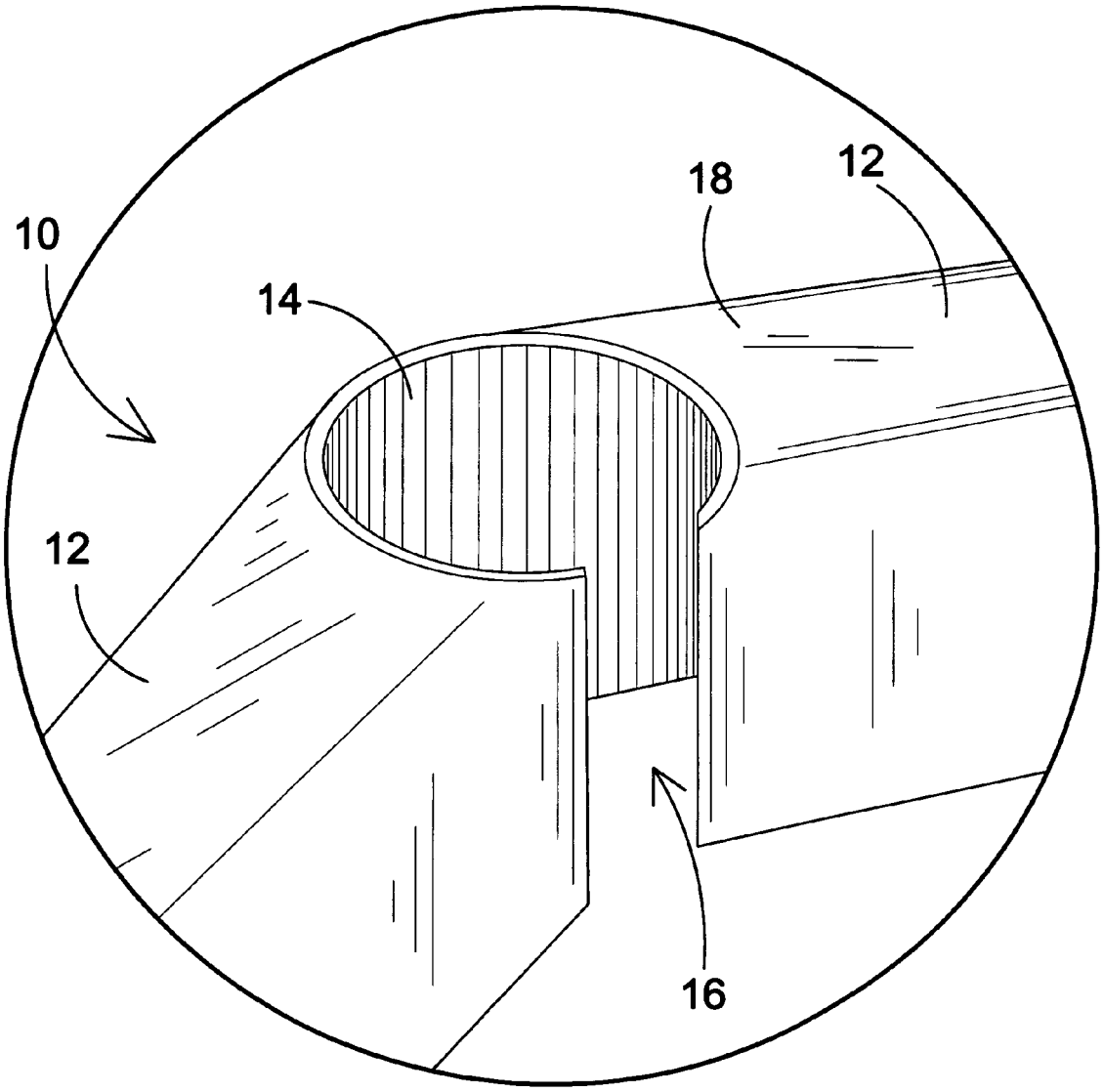
FIG. 3 is a detail view of the present invention.

Turning to FIG. 3, shown therein is a detail view of the present invention 10. The present invention 10 discloses an extension sleeve for any coat hanger comprised of divergent arms 12 forming a shoulder support 18 converging at a center point aperture 14 having a slot 16 for inserting the hook shank therein. The device 10 is designed to give a more substantial shoulder hanging support at 18 to any garment being hung, such as a shirt, blouse, sweater or jacket.

Figure 4:
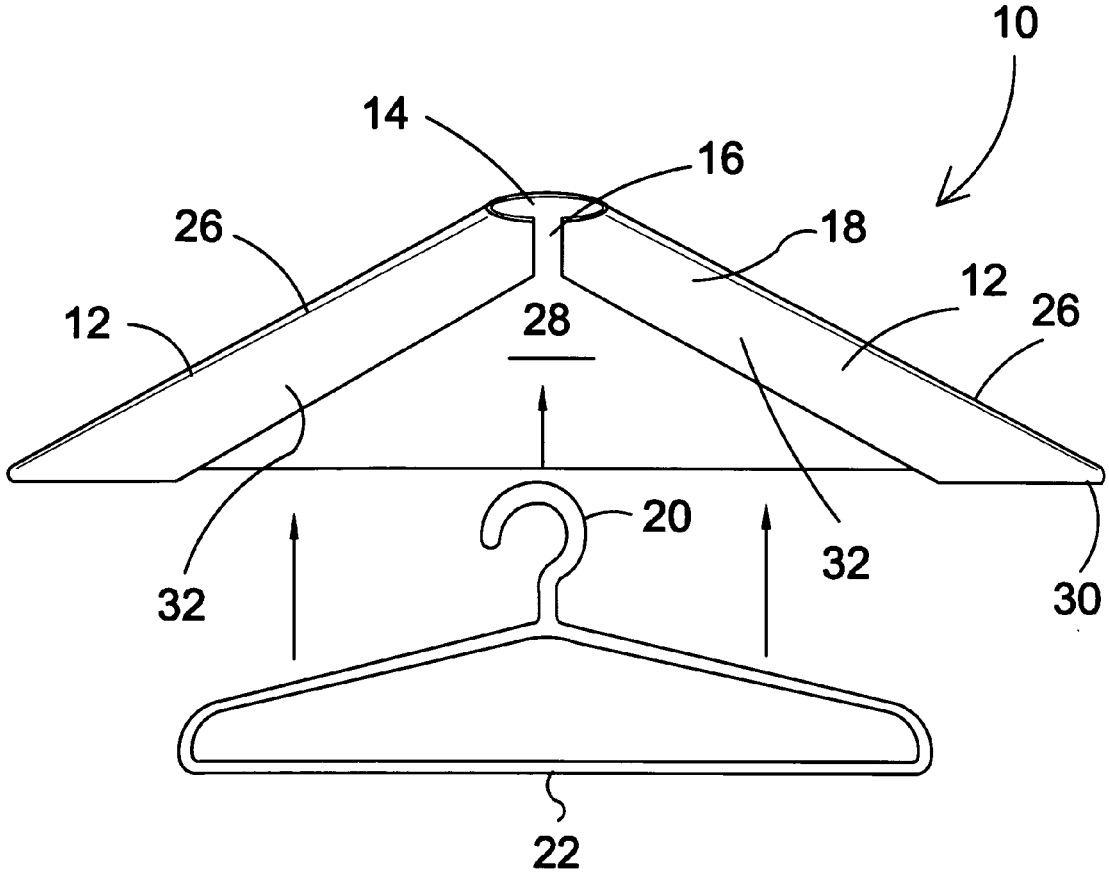
FIG. 4 is a planar view of the present invention.

Turning to FIG. 4, shown therein is a planar view of the present invention 10. The present invention 10 discloses an extension sleeve for a coat hanger 22 comprised of divergent arms 12 converging at a center point aperture 14 at the apex of the arms 12 having a vertical slot 16 for inserting the hook 20 shank of a hanger 22 therein. The device 10 is designed to give a more substantial shoulder at 18 hanging support to any garment being hung, such as a shirt, blouse, sweater or jacket. The divergent arms 12 have a curvilinear top surface at 26 sloping downwardly away from aperture 14 having a back wall 28. Skirt 32 is also shown being shorter than the back wall 28 and extending down to a point between the top of the arms and the bottom 30 of the ends of the arms. The back wall 28 extends to an imaginary line connecting the bottom 30 of the opposing arms 12 with a front skirt 32 wall having slot 16 therein. The bottom 30 is effectively wide to allow the present invention 10 to stand unaided and be stacked one upon another.

Figure 5:
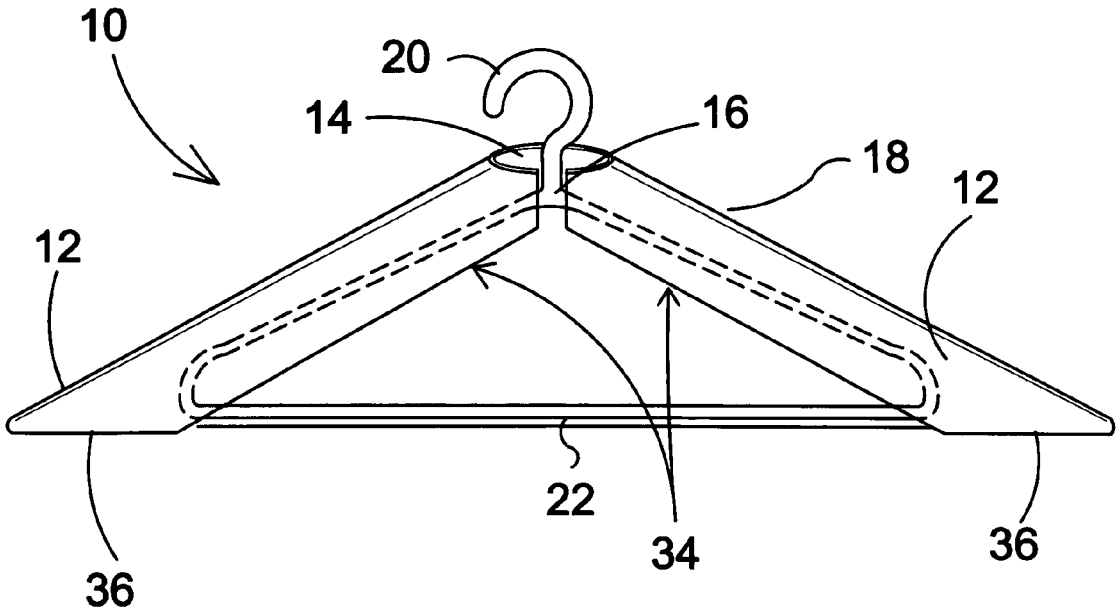
FIG. 5 is a planar view of the present invention.

Turning to FIG. 5, shown therein is a planar view of the present invention 10. The present invention 10 discloses an extension sleeve for any coat hanger 22 comprised of divergent arms 12 converging at a center point aperture 14 having a slot 16 for inserting the hook shank 20 of hanger 22 therein. The device 10 is designed to give a more substantial shoulder hanging support at 18 to any garment being hung, such as a shirt, blouse, sweater or jacket. The arms of hanger 22 are received in the interior space or cavity 34; feet 36 are also shown.

Figure 6:
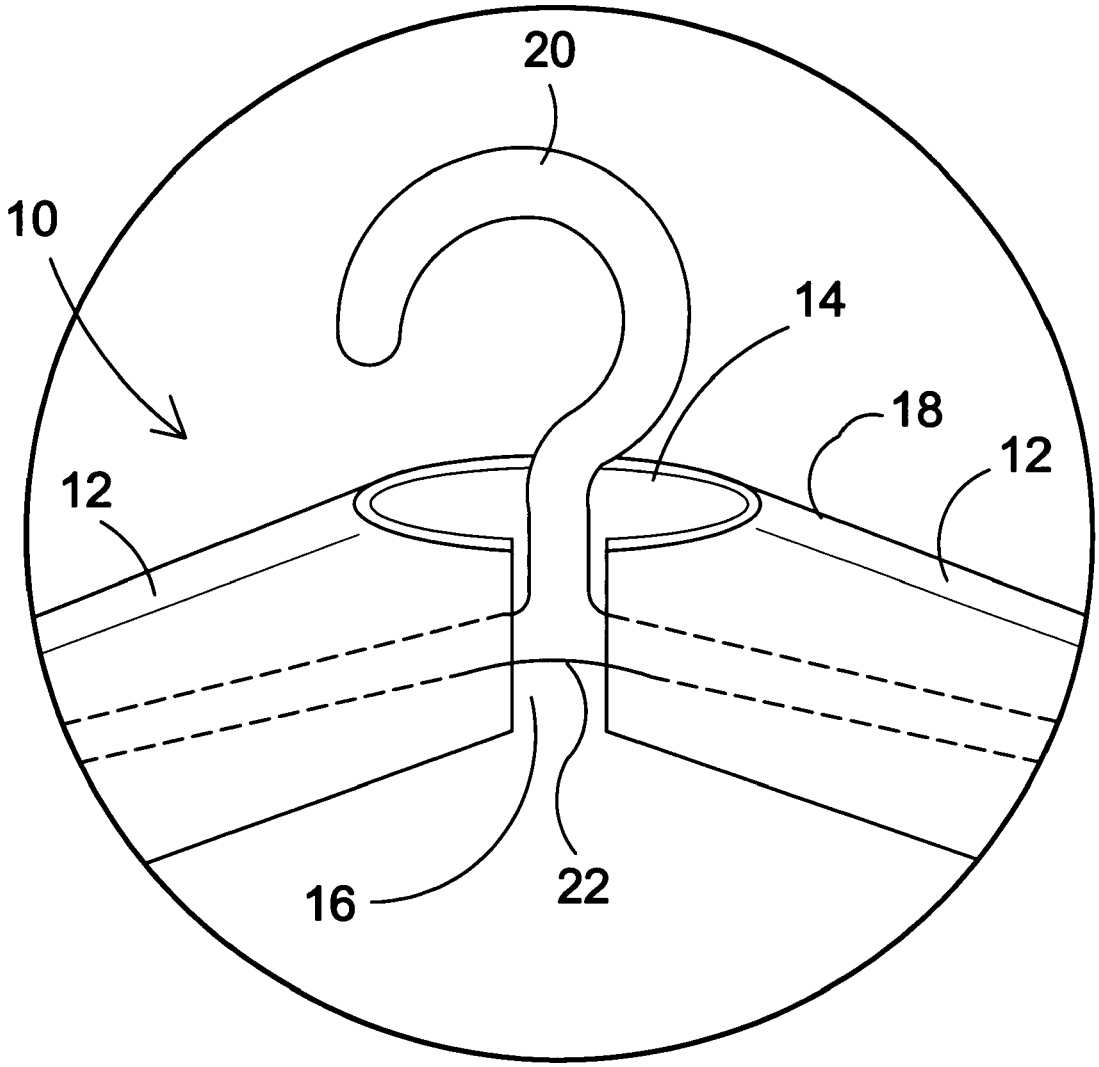
FIG. 6 is a detail view of the present invention.

Turning to FIG. 6, shown therein is a detail view of the present invention 10. The present invention 10 discloses an extension sleeve for any coat hanger 22 comprised of divergent arms 12 converging at a center point aperture 14 having a slot 16 for inserting the hook shank 20 therein. The device 10 is designed to give a more substantial shoulder hanging support at 18 to any garment being hung, such as a shirt, blouse, sweater or jacket.

Figure 7:
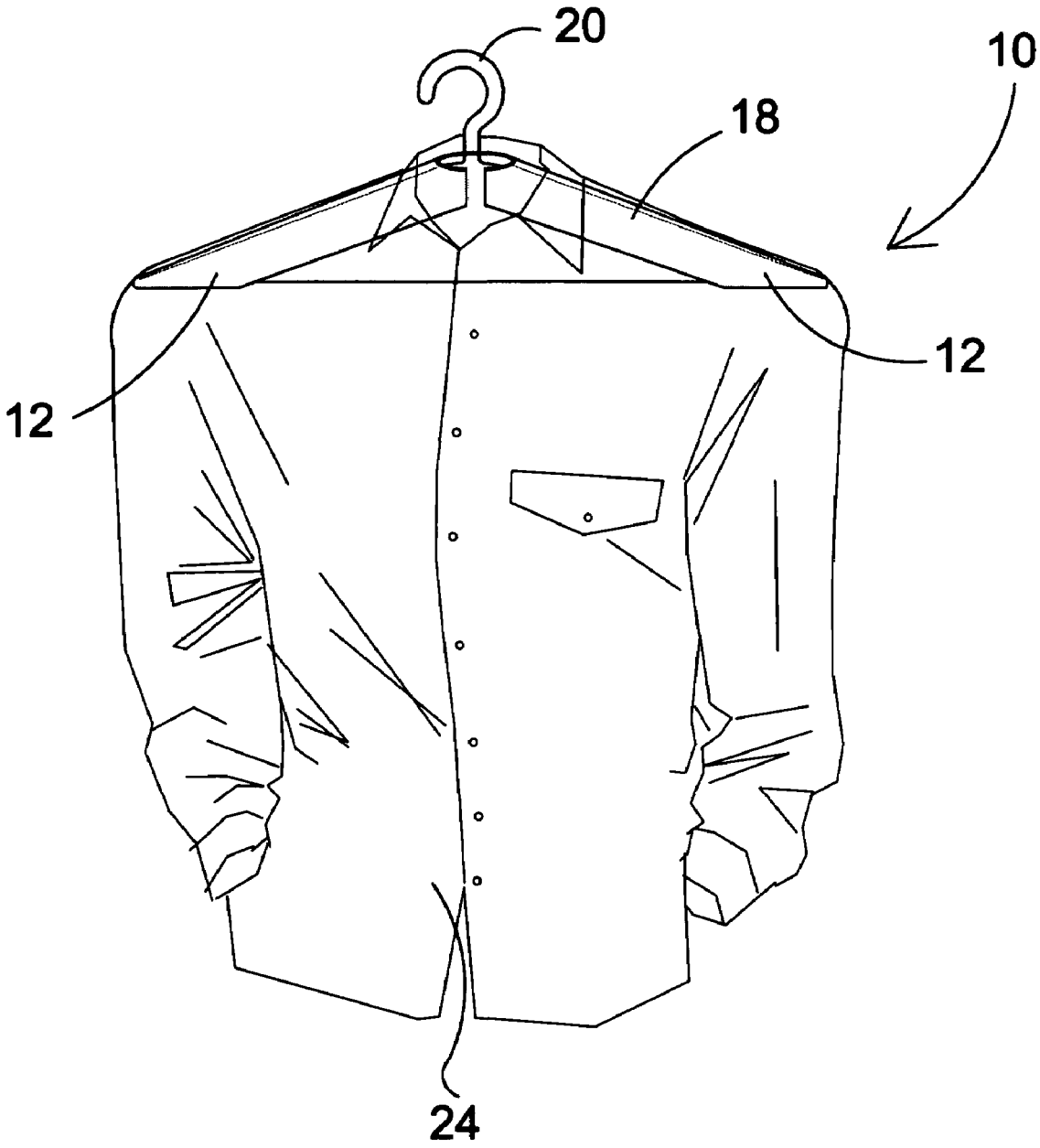
FIG. 7 is an illustrative view of the present invention.

Turning to FIG. 7, shown therein is an illustrative view of the present invention 10. The present invention 10 discloses an extension sleeve for any coat hanger comprised of divergent arms 12 converging at a center point having a slot for inserting the hook shank 20 therein. The device 10 is designed to give a more substantial shoulder hanging support at 18 to any garment 24 being hung, such as a shirt, blouse, sweater or jacket.

Figure 8:
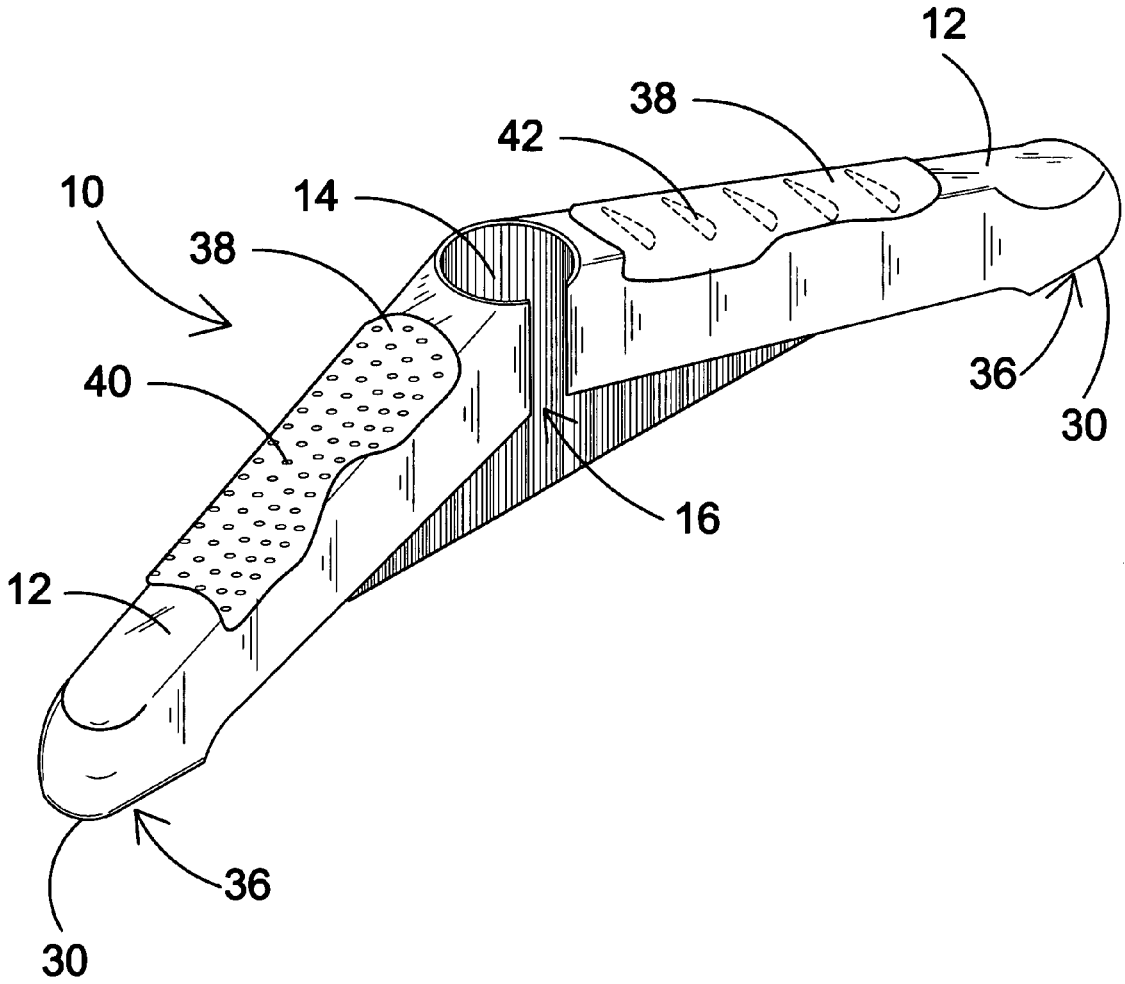
FIG. 8 is a perspective view of the present invention incorporating additional elements.

Turning to FIG. 8, shown therein is a perspective view of the present invention 10 incorporating additional elements that can be used in conjunction with each other or separately. The present invention 10 discloses an extension sleeve for any coat hanger comprised of divergent arms 12 converging at a center point aperture 14 having a slot 16 for inserting the hook shank therein. The device 10 is designed to give a more substantial shoulder hanging support to any garment being hung, such as a shirt, blouse, sweater or jacket. Note that the bottom 30 is effectively wide and also forming feet 36 on each end to allow the present invention 10 to stand unaided and be stacked one upon another. Also shown are a plurality of wedge-like projections 42 depending from the underside of the top surface having a wedge bottom surface with the opposing ends angularly displaced. As illustrated, the angularity extends to its deepest point toward the back wall causing the sleeve back wall to substantially engage the provided hanger. Additionally, the plurality of wedges 42 can be formed with the deepest end toward the front wall or by reversing every other wedge-angularity would essentially cause the coat hanger to reside between the sleeve's front and back wall. Another additional elements is provided for in the form of frictional material 38 covering the top surface in whole or in part preventing casual displacement of the garment. The frictional material can have a roughened surface, such as nubs 40 depending from the frictional material.

I claim:

1. An apparatus for providing an extension sleeve for use with a coat hanger, the hanger having opposing arms and a hook thereon, comprising:

a) first and second opposed, downwardly sloping arms, said arms having top, front and rear surfaces and ends, wherein said top surface is curvilinear shaped, wherein each of said ends has a bottom surface;

b) a back wall extending downwardly from said top surface of said rear surface of each arm to a bottom edge entirely along a straight and horizontal line connecting said bottom of each said first and second ends;

c) a skirt wall extending downwardly a short distance from said top surface of said front surface of each arm to a point between said top of said arms and said bottom of said ends of said arms, said skirt wall having a bottom edge extending parallel to said sloping arms so that said bottom edge of said back wall is visible from the front of said extension sleeve at a level of said bottom surfaces of said sloping arms behind and below said skirt bottom edge;

d) wherein said apex of said first and second arms has an aperture therein, said aperture being disposed generally horizontally for receiving the hook of the hanger therethrough;

e) wherein said apex of said first and second arms has a slot therein, said slot being vertically disposed in said skirt wall and extending from said aperture to said bottom edge of said skirt for receiving the hook and shank of the hanger therethrough, said vertical slot being bounded by spaced, straight and vertical and parallel side edges of said first and second arms;

f) wherein said top, front and rear surfaces of said first and second arms define a cavity therein, wherein said cavity receives the arms of the hanger therein so that the hanger is substantially covered by the apparatus;

g) the ends of said first and second arms are effectively wide forming feet so that the apparatus can stand on said ends unaided and the apparatus can be stacked one upon another;

h) wedge-like projections depending from the underside of the top surface wherein said wedge-like projections have a bottom surface with opposing ends angularly displaced from one another, each said projection being formed with a deepest end toward the skirt wall; and i) frictional material covering some portion of the top surface, said frictional material having nubs depending therefrom.

* * * * *